US010463145B2

(12) United States Patent
Pittes et al.

(10) Patent No.: US 10,463,145 B2
(45) Date of Patent: Nov. 5, 2019

(54) CUT-N-GO PAINTBRUSH EDGER COVER

(71) Applicants: Gary Dawayne Pittes, Tulsa, OK (US); Brylan Kristopher Walker, Tulsa, OK (US)

(72) Inventors: Gary Dawayne Pittes, Tulsa, OK (US); Brylan Kristopher Walker, Tulsa, OK (US)

(73) Assignee: Gary Pittes, Tulsa, OK (US)

( * ) Notice: Subject to any disclaimer, the term of this patent is extended or adjusted under 35 U.S.C. 154(b) by 115 days.

(21) Appl. No.: 15/932,152

(22) Filed: Feb. 12, 2018

(65) Prior Publication Data

US 2019/0246785 A1 Aug. 15, 2019

(51) Int. Cl.

| | |
|---|---|
| ***A46B 17/08*** | (2006.01) |
| ***B05C 21/00*** | (2006.01) |
| ***A46B 17/04*** | (2006.01) |

(52) U.S. Cl.

CPC ..... *A46B 17/08* (2013.01); *A46B 17/04* (2013.01); *B05C 21/005* (2013.01)

(58) Field of Classification Search

CPC ..... A46B 17/00; A46B 17/04; A46B 17/08; A46B 2200/202; B05C 21/005; B44D 3/128

See application file for complete search history.

(56) References Cited

U.S. PATENT DOCUMENTS

| | | | | | |
|---|---|---|---|---|---|
| 2,078,193 | A * | 4/1937 | Campbell | A46B 17/08 | 15/166 |
| 2,820,237 | A * | 1/1958 | Maslaney | A46B 17/08 | 15/248.1 |
| 6,163,920 | A * | 12/2000 | Meyer | A46B 17/08 | 15/246 |
| 2003/0135945 | A1* | 7/2003 | Nordstrom | A46B 17/04 | 15/168 |
| 2015/0223593 | A1* | 8/2015 | Sguera | A46B 17/08 | 15/175 |
| 2015/0374113 | A1* | 12/2015 | Walker | A46B 17/08 | 15/248.1 |

* cited by examiner

*Primary Examiner* — Ryan A Reis
(74) *Attorney, Agent, or Firm* — Gary Pittes

(57) ABSTRACT

An adjustable paintbrush edger cover adjustable with a complimentary cutout that forms around paintbrush, adjustable paintbrush edger cover has two sides, open on both ends, lined with tabs to keep adjustable paintbrush edger cover from coming in contact with paintbrush bristles, adjustable paintbrush edger cover angled on top end of edger, tabs on both inside top end of adjustable paintbrush edger cover therefore, angled end on same end of paintbrush bristles therefore, inside tabs keeps bristles away from trim, molding, ceilings and floors, which keeps paint from coming in contact with trim, molding, ceilings and floors.

3 Claims, 3 Drawing Sheets

15
14
13

CUT-N-GO PAINTBRUSH EDGER COVER

BACKGROUND OF INVENTION

This invention relates to a paintbrush edger cover and more particularly to an adjustable paintbrush edger cover, which is designed with trim tabs, which gives house painters precision control, in which trim tabs holds a cut close exact distance from trim, molding, ceilings and floors, also designed to accommodate various foam brushes and paintbrush sizes. However, this adjustable paintbrush edger cover makes edging and trimming simple and efficient without the use of masking tape, paper, and plastic. Angled paintbrush bristles and edger's have been known for many years and have been somewhat effective; however, most prior edger's of which applicant is aware are relatively expensive, time consuming, and messy. In addition the cost of masking paper, masking tape and plastic can be rather expensive.

BRIEF SUMMARY OF THE INVENTION

The present invention overcomes the problems of prior art devices known to applicant by providing a relatively simple and inexpensive edging mechanism, which can be used with a wide variety of different size paintbrushes. This is accomplished with an adjustable paintbrush edger cover with trim tabs, and a complementary cut out that receives a paintbrush, edger cover has two sides, open on both ends lined with drip tabs to keep adjustable edger cover from coming in contact with paintbrush bristles, adjustable edger cover is angled on top end of edger, tabs on both inside top end of adjustable edger cover; therefore, angled end of same end of paintbrush bristles in which bristles are visible at angled end of adjustable edger cover, tabs keeps bristles away from trim, molding, ceilings and floors, which keeps paint from coming into contact with trim, molding, ceilings and floors.

BRIEF DESCRIPTION OF THE DRAWING FIGURES

For the purpose of illustrating the invention, there is shown in the accompanying drawings one form which is presently preferred; it being understood that the invention is not intended to be limited to the precise arrangement and instrumentalities shown.

FIG. 1B is an elevated view showing (A) Top View, (B) Front View, (C) Side View

DETAILED DESCRIPTION OF THE INVENTION

Figure 1:
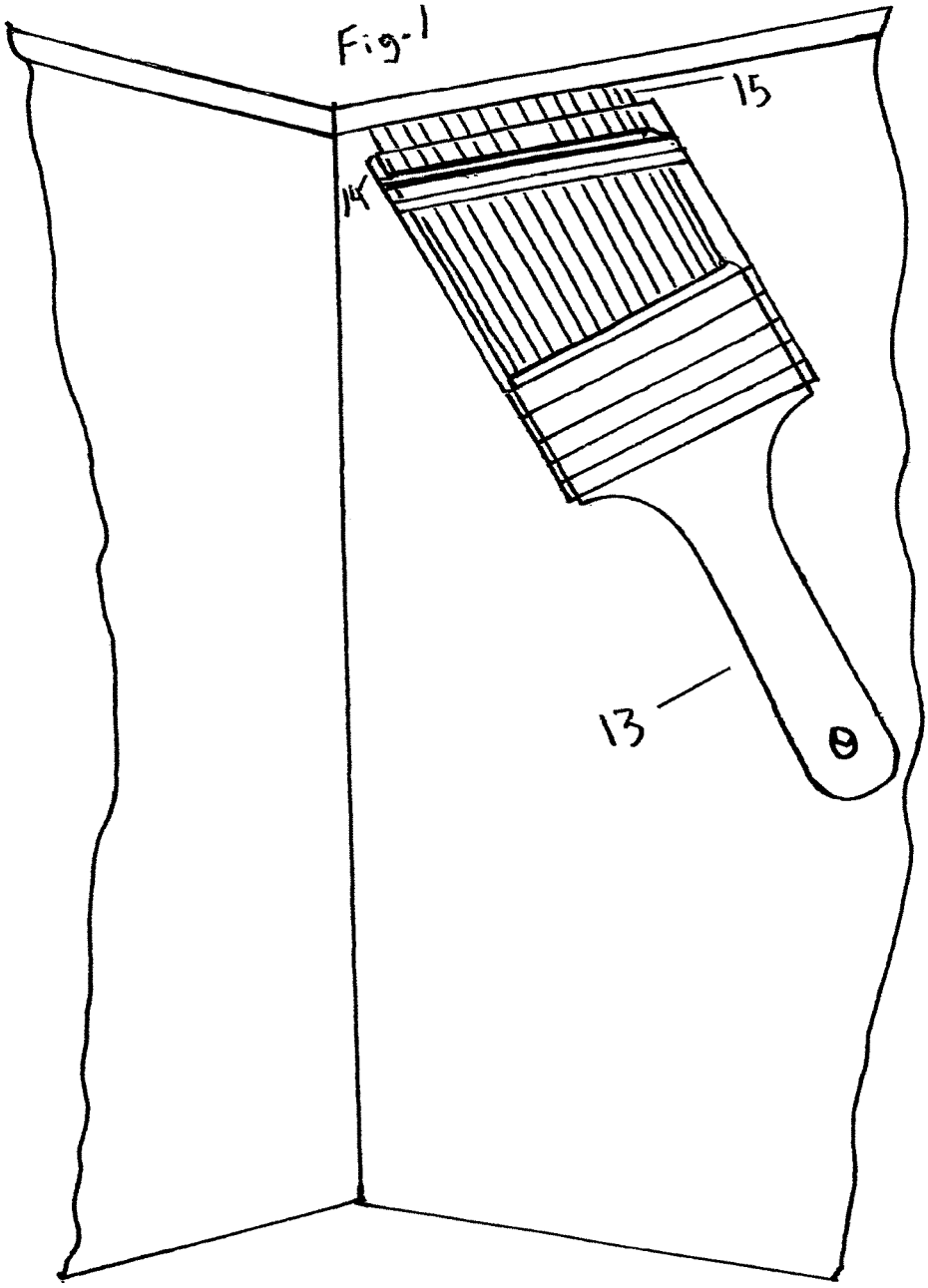
FIG. 1 is a perspective view of the adjustable paintbrush edger cover being attached to a paintbrush utilizing the present invention.
Figure 1A:
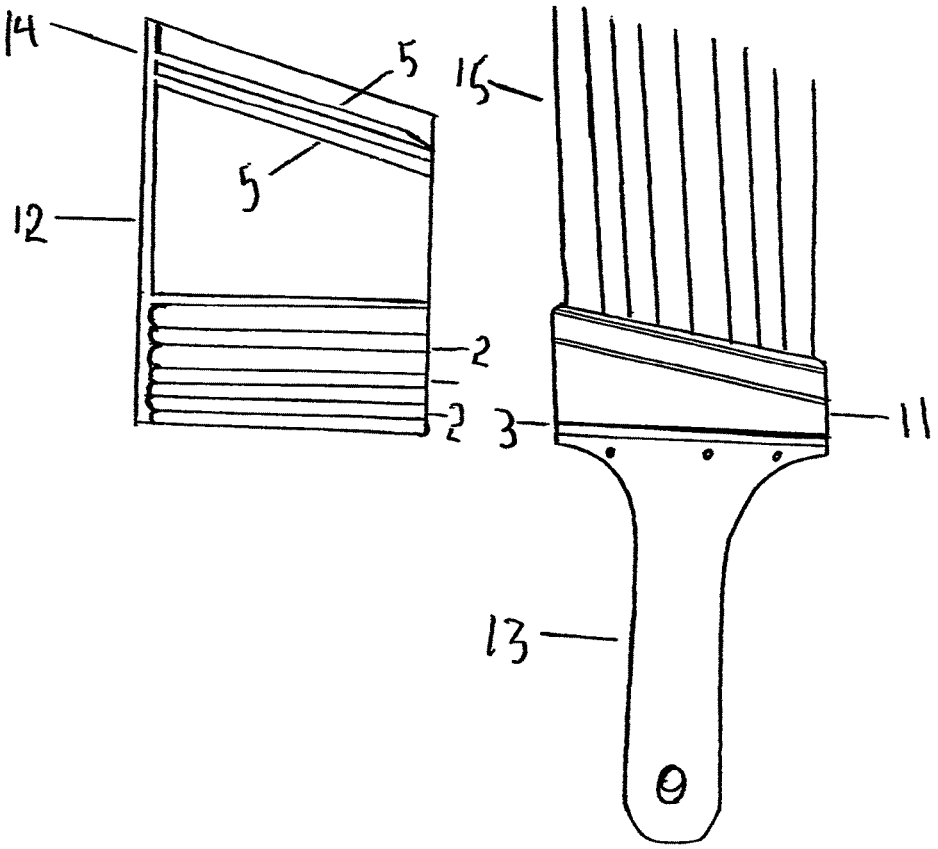
FIG. 1A is an exploded view showing the adjustable paintbrush edger cover the components of the present invention and illustrating the interrelationship of the adjustable paintbrush edger cover and paintbrush.
Figure 18:
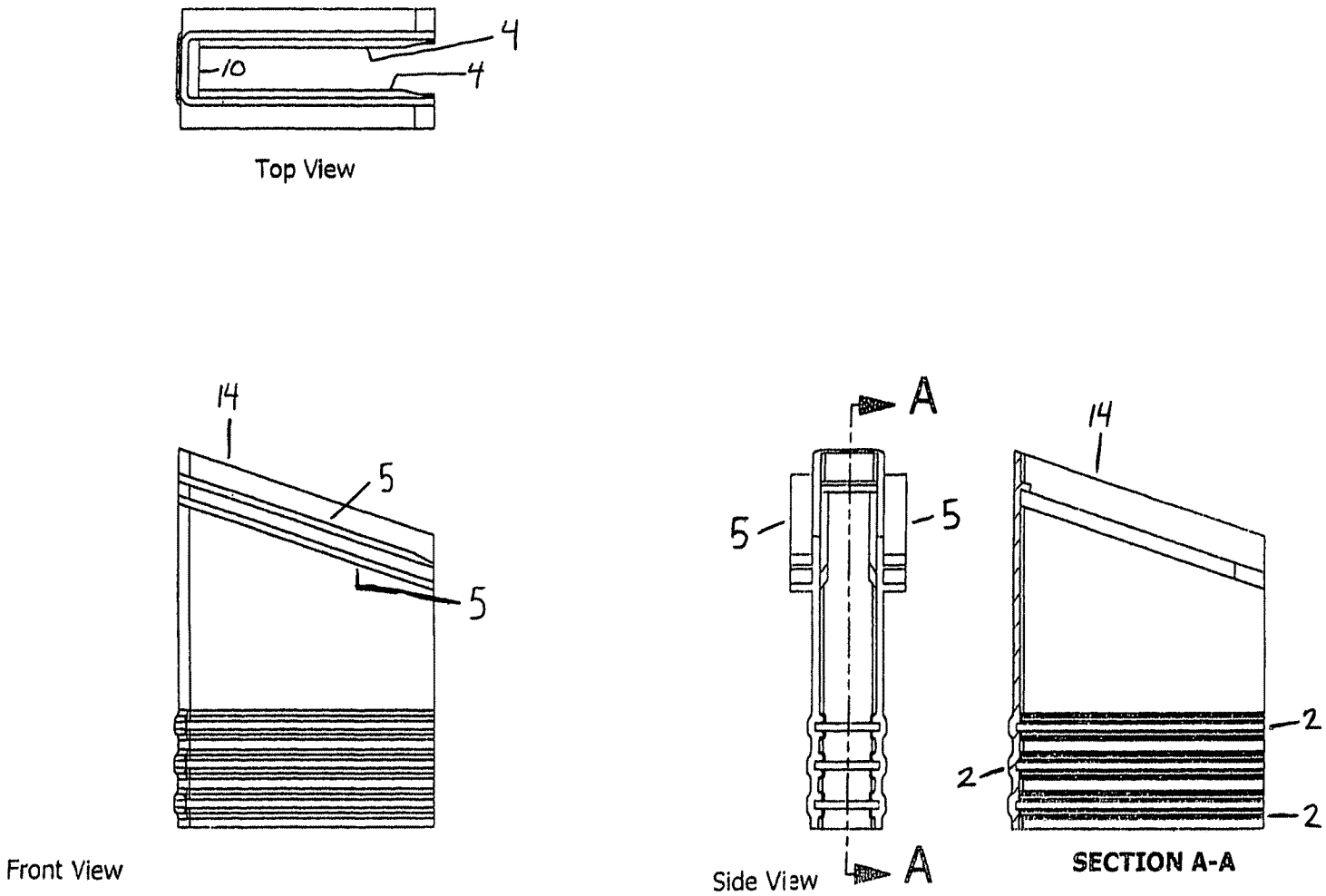

Referring to the drawings in detail, wherein like reference numerals have been used throughout the various figures to identify like elements, FIG. 1 is a perspective view showing the adjustable paintbrush edger cover 12 attached to paintbrush. As shown most clearly in FIG. 1 paintbrush edger cover 12 with slotted cut-outs 2 lines up with raised strip 3 allows paintbrush to attach adjustable paintbrush edger 12. As shown most clearly in FIG. 1A is adjustable by moving slotted cut-out up or down on raised strip 3 on bottom end of ferrule 11 as shown most clearly in FIG. 1A bristles 15 exposed on angled end 14 also shown in FIG. 1 drip tabs 4 lined on inside of top angled end 14 as shown most clearly in FIG. 18 exterior trim tabs 5 also on angled end 14 as shown most clearly in FIG. 1B spacer 10 shown clearly in FIG. 1B.

EMBODIMENT LIST

2. Slotted cut-outs
3. Raised strip
4. Drip tabs
5. Trim tabs
10. Spacer
11. Ferrule
12. Adjustable paintbrush edger cover
13. Paintbrush handle
14. Angled end of adjustable paintbrush edger cover
15. Bristles

We claim:

1. An adjustable paintbrush edger cover used to accommodate house painters for exterior and interior painting, with precision control for trimming without excess paint coming in contact with molding, trim, ceilings and floors, the adjustable paintbrush edger cover compromising:

an elongated body having three sidewalls made of hardened material and a complimentary cut-out that allows the elongated body to form around and attach to a paintbrush;

a plurality of drip tabs on an interior of a top angled end of the elongated body where paintbrush bristles of the paintbrush are exposed;

a plurality of trim tabs on an exterior of the top angled end of the elongated body; and a plurality of slotted cut-outs on an interior of a bottom end of the elongated body configured to align with a raised strip on the paintbrush, wherein the slotted cut-outs allow the paintbrush edger cover to adjust vertically relative to the paintbrush.

2. The adjustable paintbrush edger cover of claim 1, wherein the paintbrush edger cover is made of hardened plastic.

3. The adjustable paintbrush edger cover of claim 1, further comprising using hand pressure to attach the paintbrush edger cover to the paintbrush.

* * * * *